US008267058B2

(12) United States Patent
Suzuki et al.

(10) Patent No.: US 8,267,058 B2
(45) Date of Patent: Sep. 18, 2012

(54) VALVE OPENING/CLOSING TIMING CONTROL APPARATUS

(75) Inventors: Shigemitsu Suzuki, Takahama (JP); Toru Fujikawa, Obu (JP); Yasutaka Miura, Anjo (JP); Naoto Toma, Kariya (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 426 days.

(21) Appl. No.: 12/602,631

(22) PCT Filed: Sep. 8, 2008

(86) PCT No.: PCT/JP2008/066153

§ 371 (c)(1), (2), (4) Date: Dec. 1, 2009

(87) PCT Pub. No.: WO2009/037987

PCT Pub. Date: Mar. 26, 2009

(65) Prior Publication Data

US 2010/0175650 A1 Jul. 15, 2010

(30) Foreign Application Priority Data

Sep. 19, 2007 (JP) ..... 2007-242384

(51) Int. Cl.
*F01L 1/34* (2006.01)

(52) U.S. Cl. ..... 123/90.17

(58) Field of Classification Search ..... 123/90.12, 123/90.15, 90.17
See application file for complete search history.

(56) References Cited

U.S. PATENT DOCUMENTS

| | | | | |
|---|---|---|---|---|
| 5,738,056 | A | 4/1998 | Mikame et al. | |
| 5,901,674 | A | 5/1999 | Fujiwaki | |
| 6,439,181 | B1 | 8/2002 | Fujiwaki et al. | |
| 7,536,985 | B2 * | 5/2009 | Suzuki et al. | 123/90.17 |
| 2002/0100445 | A1 | 8/2002 | Takenaka et al. | |
| 2003/0121486 | A1 | 7/2003 | Komazawa et al. | |
| 2006/0144357 | A1 | 7/2006 | Knecht et al. | |

(Continued)

FOREIGN PATENT DOCUMENTS

EP 1 672 188 A1 6/2006

(Continued)

OTHER PUBLICATIONS

Supplementary European Search Report dated Sep. 7, 2011, issued in European Patent Application No. 08831906.6-2311.

(Continued)

*Primary Examiner* — Thomas Denion
*Assistant Examiner* — Daniel Bernstein
(74) *Attorney, Agent, or Firm* — Buchanan Ingersoll & Rooney PC

(57) ABSTRACT

A valve opening/closing timing control apparatus includes a phase displacing mechanism for displacing relative phase between a drive-side rotational member and a driven-side rotational member rotatable in unison with a cam shaft, a first pump driven by an internal combustion engine, a second pump driven by a drive source different from the internal combustion engine, a locking mechanism capable of locking the relative phase to an initial phase suitable for starting the internal combustion engine, and an urging mechanism 3 for urging the phase displacing mechanism in the advancing direction between the most retarding phase and the initial phase, a minimal urging force of the urging mechanism being set so as to override the displacing force toward the retarding phase side at the minimal pressure.

4 Claims, 5 Drawing Sheets

U.S. PATENT DOCUMENTS

| | | | | |
|---|---|---|---|---|
| 2008/0022953 | A1 | 1/2008 | Kanada et al. | |
| 2009/0025668 | A1 | 1/2009 | Matsusaka et al. | |
| 2010/0175649 | A1 * | 7/2010 | Suzuki et al. ..... | 123/90.17 |

FOREIGN PATENT DOCUMENTS

| | | | |
|---|---|---|---|
| GB | 2 437 305 | A | 10/2007 |
| JP | 9-324613 | A | 12/1997 |
| JP | 2002-227621 | A | 8/2002 |
| JP | 2002-295276 | A | 10/2002 |
| JP | 2004-060572 | A | 2/2004 |
| JP | 2006-037886 | A | 2/2006 |
| JP | 2006-144766 | A | 6/2006 |
| JP | 2006-322409 | A | 11/2006 |
| JP | 2006-348926 | A | 12/2006 |
| JP | 2007-132272 | A | 5/2007 |
| WO | WO 2006/011648 | A1 | 2/2006 |

OTHER PUBLICATIONS

Informal comments submitted in International Patent Application No. PCT/JP2008/066153.

English translation of International Preliminary Report on Patentability issued Apr. 7, 2010 by the International Bureau of WIPO in International Application No. PCT/JP2008/066153.

Extended European Search Report issued on Sep. 7, 2011 by the European Patent Office in corresponding European Patent Application No. 08 83 2094.

International Search Report of Application No. PCT/JP2008/066153 dated Dec. 9, 2008.

Written Opinion of the International Searching Authority (Japanese Patent Office) of Application No. PCT/JP2008/066153 dated Dec. 9, 2008.

* cited by examiner

VALVE OPENING/CLOSING TIMING CONTROL APPARATUS

TECHNICAL FIELD

The present invention relates to a valve opening/closing timing control apparatus for controlling opening/closing timing of at least one of an intake valve and an exhaust valve of an internal combustion engine.

BACKGROUND ART

The convention has implemented a valve timing control apparatus for changing opening/closing timing of an intake valve and/or an exhaust valve according to an operational condition of an internal combustion engine ("engine"). For instance, there is known a mechanism for changing the opening/closing timing of the intake valve which is opened/closed in association with rotation of a cam shaft, by changing a rotational phase of the cam shaft relative to a crank shaft. Incidentally, the intake valve and the exhaust valve each has its own timing favorable for starting the engine. And, this opening/closing timing often differs from the opening/closing timing of the same valve during traveling of the vehicle. More particularly, the rotational phase of the cam shaft at the time of start of engine is often located at an intermediate position between the angle advancing side and the angle retarding side. For mechanically fixing this position as an initial phase suitable for engine start, there is known a variable valve timing mechanism having a locking mechanism for locking the rotational phase of the cam shaft at the initial phase (see. e.g. Patent Document 1). With this variable valve timing mechanism, after the engine starts at the initial phase and subsequently enters its operational state and when the hydraulic pressure builds up thereafter, the locking mechanism is released, thus allowing phase control suitable for the operational state.

Further, in order to ensure displacement, at the time of engine start, from the retarding phase side to the intermediate locking position (initial phase) that is the relative phase suitable for engine start, a valve timing adjusting apparatus is known that has an angle advance assisting spring for assisting the phase displacement toward the advancing side (see e.g. Patent Document 2). With this valve timing adjusting apparatus, the range of urging phase of the advance assisting spring is set to the sum of the intermediate locking phase (initial phase) and 10 degrees, as measured from the maximal retarding phase. With this arrangement, even in the event of drop in the hydraulic pressure at the time of stop of the engine, the relative phase will have been displaced to the position beyond the initial phase, due to the urging force of the advance assisting spring, and at the time of start of the engine, by a cam reaction force, the relative phase will be displaced toward the retarding side, against the urging force of the advance assisting spring and the relative phase will be locked eventually at the intermediate locking position.

With the above-described valve opening/closing timing control technique according to Patent Document 2, at the time of stop of the engine, with utilization of the urging force of the advance assisting spring, the relative phase between the crank shaft and the cam shaft is displaced to a phase slightly beyond the initial phase; whereas, at the time of the start of the engine, the relative phase of the cam shaft is locked to the initial phase by means of the cam reaction force, and the force resulting from e.g. viscosity of oil, effective in the retarding direction, thus improving the start performance of the engine. Further, for allowing speedy displacement of the relative phase from the retarding side to the initial phase at the time of stopping the engine, it is desired that the urging force of the advance assisting spring be strong. However, if the force effective in the retarding direction such as the cam reaction force or due to the oil viscosity, is weak, locking to the initial phase takes long time due to the resistance of the advance assisting spring, or depending on the case, the operation becomes difficult. For this reason, the strength of the advance assisting spring needs to be set to such a degree as to allow control in the retarding direction at the minimal oil pressure. Moreover, although this valve opening/closing timing control technique is designed to lock the phase to the initial phase at the time of starting the engine, for more reliable engine start, it is desired that the locking to the initial phase be completed before the stopping of the engine.

Patent Document 1: Japanese Patent No. 3211713 (e.g. paragraphs 36-57)

Patent Document 2: Japanese Patent Application "Kokai" No. 2002-227621 (e.g. paragraphs 50-59).

DISCLOSURE OF THE INVENTION

In view of the above-described drawbacks of the conventional valve opening/closing timing control techniques, the object of the present invention is to provide a valve opening/closing timing control apparatus which allows completion of locking to the initial phase a the time of stopping the engine and which allows the control operation in the retarding direction to proceed smoothly even at the minimal oil pressure condition, in spite of use of an urging mechanism having a strong urging force.

For accomplishing the above-noted object, a valve opening/closing timing control apparatus according to the present invention, comprises:

a phase displacing mechanism for displacing relative phase between a drive-side rotational member rotatable in synchronism with a crank shaft of an internal combustion engine and a driven-side rotational member arranged coaxially relative to the drive-side rotational member and rotatable in unison with a cam shaft for opening/closing at least one of an intake valve and an exhaust valve of the internal combustion engine, by feeding/discharging a work fluid to/from each one of two kinds of pressure chambers whose capacities are variable in complementing manner with each other by means of a movable partition;

a first pump driven by said internal combustion engine for feeding work fluid to said phase displacing mechanism;

a second pump driven by a drive source different from said internal combustion engine for feeding work fluid to said phase displacing mechanism;

a locking mechanism capable of locking said relative phase to an initial phase suitable for starting the internal combustion engine and releasing this lock by a work fluid when needed, said locking mechanism creating a condition for restricting displacement range of said relative phase in a stepwise fashion; and an urging mechanism configured to provide an urging function for urging said phase displacing mechanism toward an advancing side in a restricted range between from a most retarding phase to said initial phase, a minimal urging force of said urging mechanism within said restricted urging force effective range, being set so as to override the displacing force toward the retarding phase side provided by said phase displacing mechanism fed with the work fluid at a minimal pressure from said first pump.

Normally, an internal combustion engine ("engine") is stopped during its idling state. So, the relative phase provided by the phase displacing mechanism is in a retarding region in this situation. With the present invention, if engine stop is requested in the retarding region, this relative phase is speedily shifted to the initial phase region suitable for engine start by a displacing force due to the urging force toward the advancing side generated by the urging mechanism. Once beyond the initial phase, the urging force of the urging mechanism becomes non-effective, so that the driven-side rotational member is returned to the retarding side by the cam reaction force and becomes eventually locked to the initial phase by the locking mechanism. Further, the shortage in the pressure of work fluid that occurs in association with engine stop can be compensated for by the second pump. Therefore, unlike the conventional apparatus disclosed in Patent Document 1 described above, there is no need to set the urging force of the urging mechanism to be weaker than the displacing force in the retarding direction by the work fluid at the minimal pressure generated by the first pump. Hence, it is possible to employ an urging mechanism having a greater urging force. With this arrangement, the returning from the retarding phase region to the initial phase can take place in a speedy manner. Further, as the locking mechanism creates the condition of restricting the displacement range of the relative phase in a stepwise fashion, the displacement range of the relative phase is restricted relative to the initial phase in a stepwise fashion. As a result, even if the cam reaction force varies alternately, the displacement toward the initial phase and the locking to the initial phase can be effected smoothly.

According to one preferred mode of implementing said locking mechanism achieving the above-described advantageous function/effect, this locking mechanism includes:

a first locking piece and a second locking piece that are provided on one of said drive-side rotational member and said driven-side rotational member;

a retaining recess provided in the other rotational member for allowing insertion therein of said first locking piece and said second locking piece;

wherein said retaining recess includes a first assisting retaining recess allowing relative displacement of said first locking piece over a predetermined region from said initial phase in the advancing direction and a second assisting retaining recess allowing relative displacement of said second locking piece over a predetermined region from said initial phase in the retarding direction. With this arrangement, as either one of the first locking piece and the second locking piece enters the retaining recess, the displacement width of the relative phase is restricted to the length of the retaining recess. Thereafter, when the other locking piece enters the assisting retaining recess, the displacement width of the relative phase is restricted to the length of the assisting retaining recess and further when both the first locking piece and the second locking piece enter the retaining recess, the relative phase is locked to the initial phase.

If a flow passage of the work fluid for the locking mechanism is formed as a flow passage independent of a flow passage of the work fluid for the phase displacing mechanism, the locking operation and the lock releasing operation of the locking mechanism can be effected, irrespectively of feeding and discharging operations of the work fluid to/from the pressure chamber. As a result, the arrangement allows for greater freedom in the locking control.

According to a still further arrangement of the valve opening/closing timing control apparatus of the invention, in case said relative phase is off said initial phase region at the time of issuance of request for stopping the internal combustion engine, said second pump is activated during a period from the issuance of the engine stop request to detection of stop of the engine, so as to assist the operation for returning the relative phase to the initial phase. When the internal combustion engine is stopped, the first pump too is stopped. With this, the pressure of the work fluid provided by the first pump will be lost. However, this loss is compensated for by the pressure of work fluid provided by the second pump that is driven by a different power source than the engine. Therefore, when the engine is stopped at an retarded phase, there is provided an increased displacing force together with the urging force of the urging mechanism from the retarding phase region to the initial phase, so that the returning to the initial phase is effected speedily. Moreover, the pressure of the work fluid by this second pump can be utilized as an assisting force for overcoming the urging force of the urging mechanism at the time of displacement in the retarding direction beyond the initial phase. With this inventive arrangement, it is possible to increase the displacing force from the retarding region to the initial phase and the displacing force from the advancing region to the initial phase, thus allowing speedy returns to the initial phase.

According to the present invention, the minimal urging force in the urging force effective range is set to override the displacing force in the retarding direction by the phase displacing mechanism when fed with the work fluid of minimal pressure by the first pump. For this reason, advantageously, for the displacement of the relative phase in the retarding direction beyond the initial phase under the condition of the work fluid fed by the first pump having the minimal pressure, the second pump is activated.

BEST MODE OF EMBODYING THE INVENTION

Figure 1:
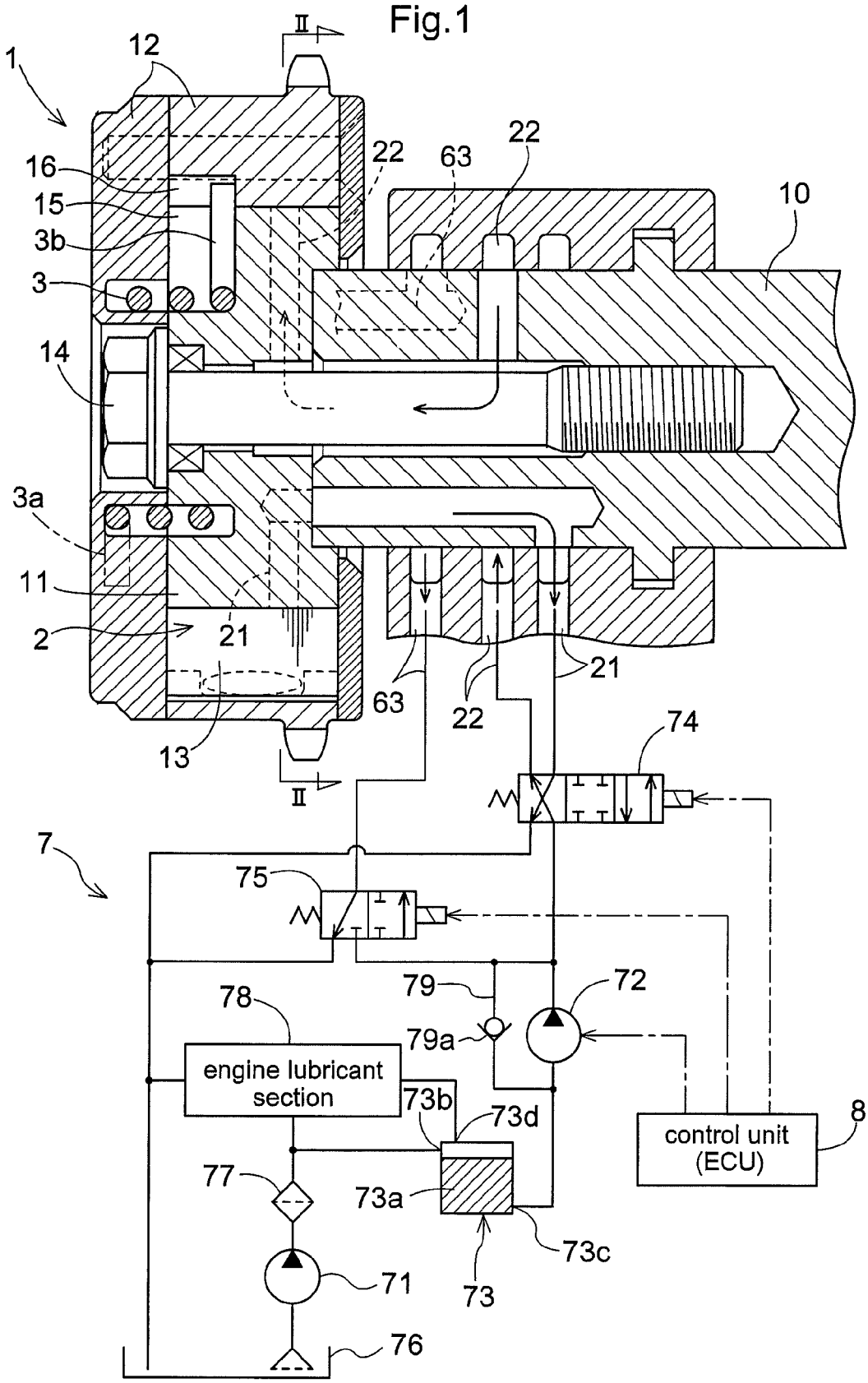
FIG. 1 is a cutaway section view showing a general construction of a valve opening/closing timing control apparatus according to the present invention.
Figure 2:
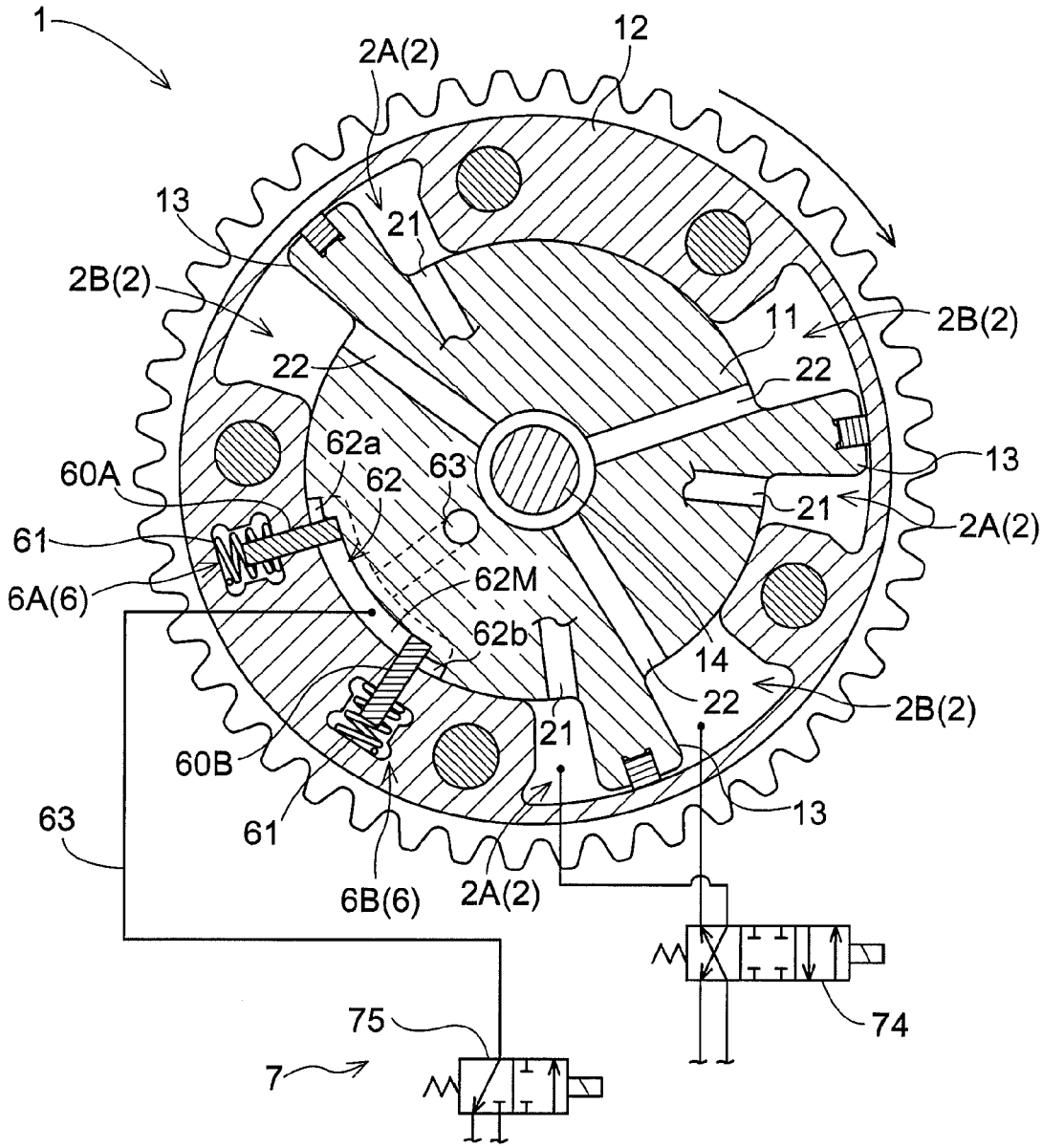
FIG. 2 shows a section II-II in FIG. 1 under one operational condition of the valve opening/closing timing control apparatus.

Next, one embodiment of the present invention will be described with reference to the accompanying drawings. FIG. 1 is a cutaway section view schematically showing the construction of a valve opening/closing timing control apparatus according to the present invention. FIG. 2 is a section view taken along a line II-II in FIG. 1, as a plane view schematically showing a condition of a phase displacing mechanism under one operational state. Numeral 1 in the figures denotes the phase displacing mechanism. This phase displacing mechanism 1 includes a drive-side rotational member 12 rotatable in synchronism with an internal combustion engine ("engine") and a driven-side rotational member 11 arranged coaxially with the drive-side rotational member 12. In the instant embodiment, there is illustrated an exemplary arrangement of the driven-side rotational member 11 being disposed on the inner side of the drive-side rotational member 12. And, the drive-side rotational member 12 is provided in the exemplary form of a pulley or a sprocket as shown. The drive-side rotational member 12 receives rotational force from a crank shaft of the engine via an unillustrated belt or chain. The driven-side rotational member 11 is fixed on a cam shaft 10 via a bolt 14 and is rotatable in unison with the drive-side rotational member 12, to rotate the cam shaft 10, thus opening/closing an intake valve and/or an exhaust valve of the engine.

Between the drive-side rotational member 12 and the driven-side rotational member 11, there are formed cavities 2. Each cavity 2 is divided into two kinds of pressure chambers 2A and 2B by means of a vane 13 acting as a movable partition therebetween. While the total capacity of the cavity remains fixed, as the position of the vane 13 is varied within the cavity, respective capacities of the two kinds of pressure chambers 2A and 2B are varied correspondingly in a mutually complimentary manner. And, in association with this change of capacities, the opening/closing timings of the intake valve and/or exhaust valve for the piston-operating engine are changed. Incidentally, the partition between the pressure chamber 2A and the pressure chamber 2B is not limited to the vane 13 provided in the form of block shown in FIG. 2, but can be provided by a plate-like member, instead.

In the instant embodiment, the phase displacing mechanism as a whole rotates clockwise. FIG. 2 shows a condition of an initial phase that is set as being suitable for start of the internal combustion engine. This initial phase is set within an intermediate region between a most retarding phase where the relative phase of the driven-side rotational member 11 relative to the drive-side rotational member 12 is most retarded and a most advancing phase where the relative phase of the driven-side rotational member 11 relative to the drive-side rotational member is most advanced. and fixedly maintained, i.e. locked, by a locking mechanism 6 to be described later. With the valve opening/closing timing control apparatus of the present invention, at the time of stopping the engine, the relative phase between the drive-side rotational member 12 and the driven-side rotational member 11 is displaced to this initial phase and maintained thereto by the locking mechanism 6. Therefore, at this initial phase condition, the engine can be started in a reliable manner.

Upon release of the lock by the locking mechanism 6 from the condition shown in FIG. 2 and if work fluid is fed into the pressure chamber 2A and discharged from the pressure chamber 2B, due to corresponding increase in the relative capacity of the pressure chamber 2A as compared to that of the other pressure chamber 2B, the phase of the drive-side rotational member 11 is controlled or displaced toward the retarding side relative to the drive-side rotational member 12. Conversely, if the work fluid is fed into the pressure chamber 2B and discharged from the pressure chamber 2A, the phase of the drive-side rotational member 11 is controlled or displaced toward the advancing side relative to the drive-side rotational member 12. For this reason, in the following explanation of the present embodiment, the pressure chamber 2A will be referred to as an advancing chamber and the pressure chamber 2B will be referred to as a retarding chamber, respectively. Further, in FIG. 1, a passage 21 communicating to the retarding chamber 2A will be referred to as a retarding passage and a passage 22 communicating to the advancing chamber 2B will be referred to as an advancing passage, respectively. It should be noted here that the retarding chamber 2A and the advancing chamber 2B are not completely sealed, so that if an amount of work oil exceeding the respective capacity thereof is fed thereto, the excess amount of fluid will leak to the outside of the phase displacing mechanism 1. An example of the work fluid is engine oil and this leaking excess work fluid or engine oil will be recovered together with an amount of work fluid (engine oil) fed to the respective parts of the engine.

Between the drive-side rotational member 12 and the driven-side rotational member 11, there is interposed a torsion spring 3 as an "urging mechanism" for urging the phase displacing mechanism 1 in the direction toward the initial phase. This torsion spring 3 provides an urging force (phase displacement assisting torque) for urging the driven-side rotational member 11 in the advancing direction relative to the drive-side rotational member 12. Namely, the drive-side rotational member 11 tends to lag, in its displacement, relative to the drive-side rotational member 12, due to resistance received from a valve spring of the intake valve or exhaust valve and/or from the phase displacing mechanism 1. The torsion spring 3 acts to restrict this lag, i.e. displacement of the phase toward the retarding side, more particularly, displacement of the phase toward the retarding side, and contributes also to rending smooth the return to the initial phase at the time of engine start.

Referring to FIG. 1, a hydraulic circuit 7 includes a first pump 71 driven by the engine for effecting feeding of oil (this also is engine oil) as the work fluid, a second pump 72, and a work oil reservoir 73 disposed between the first pump 71 and the second pump 72 and capable of reserving an amount of the work oil. The second pump 72 is disposed on the downstream of the first pump 71 and is driven by a power source separate from the engine for effecting feeding of the work oil. In addition to the above, the hydraulic circuit 7 further includes a first control valve 74 for controlling feeding of the work oil to the pressure chambers 2, and a second control valve 75 for controlling feeding of the work oil to the locking mechanism 6. This hydraulic circuit 7 still further includes a control unit (ECU) 8 as a controlling means for controlling operations of the second pump 72, the first control valve 74 and the second control valve 75.

The control unit 8 receives signals from a sensor for detecting a crank angle and a sensor for detecting an angular (rotational) phase of a cam shaft. Based upon detection results of these sensors, the control unit 8 calculates a relative phase between the driven-side rotational member 11 and the drive-side rotational member 12 and calculates also a difference, if any, between the calculated relative phase and the initial phase together with a direction of this displacement (the advancing phase direction or retarding phase direction). And, the control unit 8 operates in such a manner that at the time of stopping engine, the relative phase between the drive-side rotational member 12 and the driven-side rotational member 11 may be displaced to the initial phase and then locked at this phase by the locking mechanism 6. Further, the control unit 8 stores, within its memory, optimum relative phases according respectively to various operational states of the engine, so that in accordance with each particular operational state (e.g. rotational speed of the engine, temperature of cooling water) separately detected, an optimum relative phase therefor may be obtained. Therefore, this control unit 8 operates also to render the relative phase optimum for any particular operational state of the engine at that moment. Moreover, this control unit 8 further receives e.g. ON/OFF information of an ignition key, information from an oil leak sensor for detecting leak of the engine oil, etc.

The first pump 71 is a mechanically driven hydraulic pump driven as receiving the drive force of the crank shaft of the engine. In operation, this first pump 71 draws the work oil reserved in an oil pan 76 via an inlet port and discharges this work oil to the downstream side via a discharge port. This discharge port of the first pump 71 is communicated via a filter 77 to an engine lubricant section 78 and a work oil reservoir 73. In this, it is noted that the engine lubricant section 78 includes all parts or components required for feeding of the work oil to the engine and its peripherals.

Further, the second pump 72 is constructed as an electrically driven pump driven by a power source different from the engine, in this case, the different power source being an electric motor in particular. With this arrangement, the second pump 72 is rendered operable according to operation signals from the control unit 8, irrespectively or independently of whatever operational state of the engine. In operation, this second pump 72 draws the work oil reserved in the work oil reservoir 73 through its inlet port and discharges this work oil to the downstream side through its discharge port. This discharge port of the second pump 72 is communicated to the first control valve 74 and the second control valve 75. Further, the hydraulic circuit 7 includes a bypass passage 79 in parallel with the second pump 72, the bypass passage 79 being configured for establishing communication between the passage on the upstream side of the second pump and the passage on the downstream side of the same. This bypass passage 79 incorporates therein a check valve 79*a*.

The work oil reservoir 73 is disposed between the first pump 71 and the second pump 72 and includes a reservoir chamber 73*a* capable of reserving a fixed amount of work oil. This work oil reservoir 73 further includes a first communication port 73*b* for communicating the reservoir chamber 73*a* to the passage downstream of the first pump 71, a second communication port 73*c* provided at a lower position than the first communication port 73*a* and configured for communicating the reservoir chamber 73*a* to the passage upstream of the second pump 72, and a lubricant communication port 73*d* provided at a higher position than the first communication port 73*b* and configured for communicating the reservoir chamber 73*a* to the engine lubricant section 78. And, the capacity of the reservoir chamber 73*a* of the work oil reservoir 73 is set such that the capacity portion of its area that is lower than the first communication port 73*b* and higher than the second communication port 73*c* may be equal to or greater than the amount (volume) of work oil needed to be fed by the second pump 72 under stopped state of the first pump 71.

Under the stopped state of the engine, namely, under the stopped condition of the first pump 71 driven thereby, the second pump 72 effects feeding operation for feeding the work oil to a fluid pressure chamber 4 and the locking mechanism 6. Accordingly, the capacity of the reservoir chamber 73*a* of the work oil reservoir 73 is set to be equal to or greater than an added-up capacity of the capacities of the fluid pressure chamber 4 and an engaging recess 51 of the locking mechanism 5 and the capacities of the pipes or the like extending from these components to the second pump 72. With this arrangement, under the stopped condition of the first pump 71, the second pump 72, instead, can effect the displacement of the relative phase between the drive-side rotational member 12 and the driven-side rotational member 11 to a target relative phase.

As the first control valve 74, it is possible to employ e.g. a variable electromagnetic spool valve configured to displace a spool slidably disposed within a sleeve, against a spring, in response to power supply to a solenoid from the control unit 8. This first control valve 74 includes an advancing port communicated to the advancing passage 22, a retarding port communicated to the retarding passage 21, a feeding port communicated to the passage downstream of the second pump 72, and a drain port communicated to the oil pan 76. And, this first control valve 74 is configured as a three-position control valve capable of effecting three modes of control, namely, an advancing control in which communications are established between the advancing port and the feeding port, and between the retarding port and the drain port, a retarding control in which communications are established between the retarding port an the feeding port and between the advancing port and the drain port, and a hold control in which the advancing port and the retarding port are closed. And, the first control valve 74 executes the advancing control or the retarding control under the operational control by the control unit 8.

As the second control valve 75, it is possible to employ a variable electromagnetic spool valve, like the first control valve 74. This second control valve 75 includes a lock port communicated to a locking passage 63 as the work oil passage of the locking mechanism 6, a feeding port communicated to the passage downstream of the second pump 72, and a drain port communicated to the oil pan 76. And, this second control valve 75 is configured as a two-position control valve capable of executing two modes of control, namely, a lock releasing control in which communication is established between the locking port and the feeding port and a locking control in which communication is established between the restricting port and the drain port. And, the second control valve 75 effects control of the locking mechanism 6 under the operational control of the control unit 8. The locking passage 63 interconnecting between this second control valve 75 and the locking mechanism 6 is independent of the passages interconnecting between the advancing passage 22 or the retarding passage 21 formed inside the phase displacing mechanism 1 to the first control valve 75. So, the control operations for feeding/discharging work oil to/from the locking mechanism 6 can be done, independently of the control operations for feeding/discharging work oil to/from the retarding chamber 2A or the advancing chamber 2B.

Figure 3:
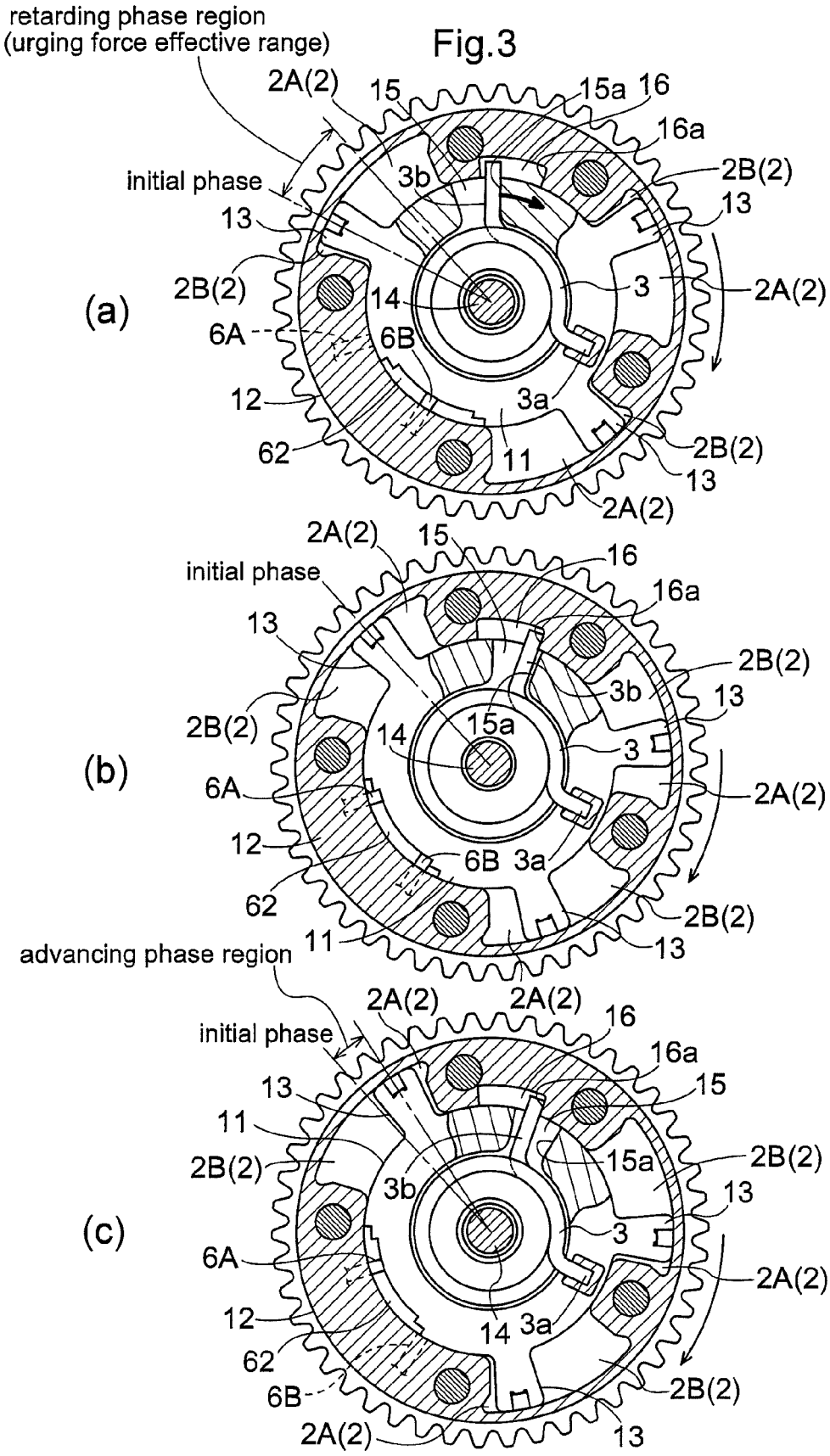
FIG. 3 is a diagram showing the valve opening/closing timing control apparatus at various relative phases.
Figure 4:
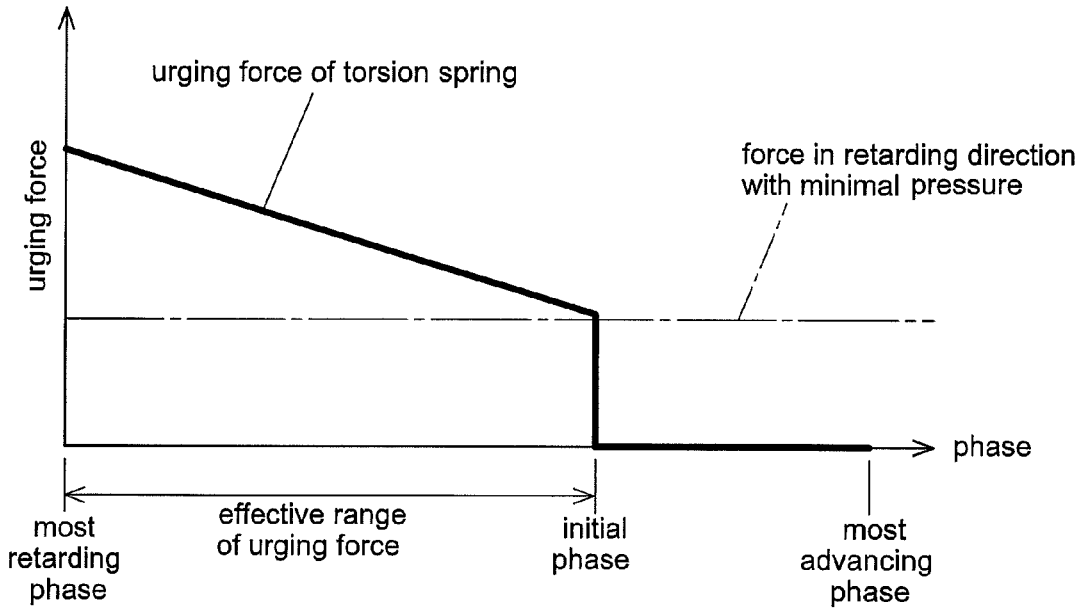
FIG. 4 is an explanatory view illustrating spring characteristics of a torsion spring.

The torsion spring 3, as shown in FIGS. 1 and 3, has its one end 3*a* fixed to the drive-side rotational member 12 and its other end 3*b* that can come into contact with a contact face 15*a* which is a lateral face along the axial direction of a radial opening 15 provided in the driven-side rotational member 11. Further, the tip end of the end 3*b* is inserted in a spring receiving recess 16 defined in the drive-side rotational member 12 and extending along the radial direction. The torsion spring 3 is configured such that its urging force for urging the driven-side rotational member 11 in the advancing direction is effective only between the most retarding phase and the initial phase. That is to say, during the transition (urging force effective region) when the relative phase between the driven-side rotational member 11 and the drive-side rotational member 12 shifts from the most retarding phase (see (a) in FIG. 3) to substantially the initial phase (see (b) in FIG. 3), the end portion 3*b* of the torsion spring 3 contacts the contact face 15*a*, thus urging the driven-side rotational member 11 in the advancing direction. However, at substantially the initial phase, the tip of the end portion 3*b* of the torsion spring 3 contacts a stopper face 16*a* of the spring receiving recess 16, thus becoming unable to urge the driven-side rotational member 11 any further. Therefore, from the substantially initial phase (see (b) in FIG. 3) to the most advancing phase (see (c) in FIG. 3), the urging force provided by the torsion spring 3 to the driven-side rotational member 11 becomes zero. This relationship between the relative phase and the urging force of the torsion spring 3 is illustrated in the graph in FIG. 4. Further, as illustrated also in FIG. 4, in this embodiment, as the torsion spring 3, there is selected a torsion spring having such strong enough spring characteristics that the minimal urging force of this torsion spring 3 in the above-described urging force effective range may exceed the displacing force in the retarding direction provided by the phase displacing mechanism 1 when fed with the work oil at the minimum pressure by the first pump 71 driven by the engine. With employment of the torsion spring 3 having such strong spring characteristics, the transition of the relative phase from the most retarding phase to the initial phase may proceed speedily, thank to the strong assisting force provided by the torsion spring 3. Also, the transition of the relative phase from the advancing phase to the initial phase and the further transition of the same to the initial phase may proceed speedily by the cam reaction force and the hydraulic force of the second pump 72 which is activated when needed, since in these displacement ranges, the urging force of the torsion spring 3 is not effective. Further, with the force in the retarding phase direction with the minimal pressure by the first pump 1 at the time of e.g. idling, it is difficult, because of the strong spring force of the torsion spring 3, for this force to maintain the relative phase in the retarding region. Therefore, in the case of the displacement in the retarding phase direction beyond the initial phase, the hydraulic force of the second pump 72 is utilized as an assisting force.

The locking mechanism 6 for locking the relative phase between the drive-side rotational member 12 and the driven-side rotational member 11 to the initial phase includes, as shown in FIG. 2, a retarding locking portion 6A and an advancing locking portion 6B both provided in the drive-side rotational member 12, and a locking recess 62 formed in the drive-side rotational member 11 at a part of its outermost peripheral face. The retarding locking portion 6A for restricting phase displacement toward the retarding side and the advancing locking portion 6B for restricting phase displacement toward the advancing side each includes a locking piece 60A, 40B supported on the drive-side rotational member 12 to be slidable in the radial direction and a spring 61 protruding to urge the respective locking piece 60A, 40B in the radially inner direction. The locking recess 62 extends along the peripheral direction of the driven-side rotational member 11 and is formed not as a one-stepped recess receiving the locking piece 60A, 60B, but as a two-stepped recess having a retaining recess 62A for providing the locking function as its original function and a first assisting retaining recess 62*a* and a second assisting retaining recess 62*b* having a shallower engaging depth for engagement with the locking piece 60*a* than the retaining recess 62A. The first assisting retaining recess 62*a* and the second assisting retaining recess 26*b* extend respectively in the advancing direction and retarding direction from the most advancing side end and from the most retarding side end of the retaining recess 62M and the peripheral lengths thereof are very short. Further, the bottom faces of the retaining recess 62A, the first assisting retaining recess 62*a* and the second assisting retaining recess 26*b* against which the tip end of the locking pieces 60A and 60B are pressed, extend substantially parallel with the outermost peripheral face of the drive-side rotational member 11. Incidentally, the shapes of the locking pieces 60A, 60B can be appropriately selected from such shapes as a plate-like shape, a pin-like shape, and the like.

In operation, the retarding locking portion 6A inhibits displacement of the driven-side rotational member 11 from the initial phase toward the retarding phase side relative to the drive-side rotational member 12 by engaging the retarding locking piece 60A into the retaining recess 62M. or the first assisting retaining recess 62*a* and the second assisting retaining recess 62*b*. On the other hand, the advancing locking portion 6B inhibits relative rotation of the driven-side rotational member 11 relative to the drive-side rotational member 12 from the initial phase toward the advancing side by bringing the advancing locking piece 60B into engagement with the locking recess 62. That is, under the condition of either one of the retarding locking piece 6A or the advancing locking piece 6*b* being engaged within the locking recess 62, the phase displacement from the initial phase to toward the retarding side or the advancing side is restricted.

The width of the retaining recess 62M that is deeper than the first assisting retaining recess 62*a* and the second assisting retaining recess 62*b* is set to be substantially equal to the distance between lateral faces of the retarding locking piece 60A and the advancing locking piece 60B which lateral faces are remote from each other in the peripheral direction of the driven-side rotational member 11. Therefore, as shown in FIG. 2 and FIG. 3 (*b*), by simultaneously engaging both the retarding locking piece 60A and the advancing locking piece 60B into the retaining recess 62M, the relative phase between the driven-side rotational member 11 and the drive-side rotational member 12 can be restricted to the initial phase having substantially zero width, i.e. the so-called locked state.

On the other hand, the first assisting retaining recess 62*a* and the second assisting retaining recess 62*b* that are shallower than the retaining recess 62M function not to render the relative phase between the driven-side rotational member 11 and the drive-side rotational member 12 into the locked state, but to maintain it within a predetermined relative phase range near the initial phase, by bringing the locking pieces 60A, 60B not engaged in the retaining recess 62M into engagement with the first assisting retaining recess 62*a* and the second assisting retaining recess 62*b*.

Incidentally, the locking recess 62 is communicated to the locking passage 63 formed in the driven-side rotational member 11 and this locking passage 63 is connected to the second control valve 75 of the hydraulic circuit 7. In operation, when the work oil is fed from the second control valve 75 via the locking passage 63 into the locking recess 62, the pair of locking pieces 60A and 60B which have been engaged within the locking recess 62 will be retracted toward the drive-side rotational member 12 until the leading ends thereof reach positions slightly radially more outward than the outermost peripheral face of the driven-side rotational member 11. With this, the locked state between the drive-side rotational member 12 and the driven-side rotational member 11 is released, thus allowing displacement of the relative phase.

With the valve opening/closing timing control apparatus described above, based upon result of phase detection indicative of which of the advancing or retarding phase the relative phase between the drive-side rotational member 12 and the driven-side rotational member 11 is located relative to the initial phase, this relative phase can be returned to and locked at the initial phase at the time of stopping the engine. As the phase is located at the initial phase at the time of engine stop, the engine can be restarted reliably at the initial phase suitable for starting the engine.

Next, examples of the control operations effected by the valve opening/closing timing control apparatus at the time of engine start and engine stop will be described.

(Starting Control)

Normally, the phase is locked at the initial phase at the time of starting the engine. So, before an ON operation of the ignition key, the phase displacing mechanism 1 is under the locked state wherein the phase is restricted as being locked to the initial phase by the locking mechanism 6. Further, the first control valve 74 is located at its neutral position and the feeding/discharging of the work oil to/from the advancing chamber 2B and the retarding chamber 2A are stopped. Then, when engine start is instructed with an ON operation of the ignition key, a cranking operation by a starter motor is effected. With this, the engine is started and the first pump 71 is rotated to allow feeding of the work oil to the advancing chamber 2B and the retarding chamber 2A. Further, the control unit 8 operates the second control valve 75 to feed the work oil to the locking passage 63, whereby the locked state of the locking mechanism 6 is released. Upon this release of the locked state, the displacing control of the relative phase becomes possible. So, the control unit 8 appropriately effects feeding of the work oil to the advancing chamber 6B and the retarding chamber 2A, thereby the adjust the relative phase; then, the normal operation is started.

(Stopping Control)

Figure 5:
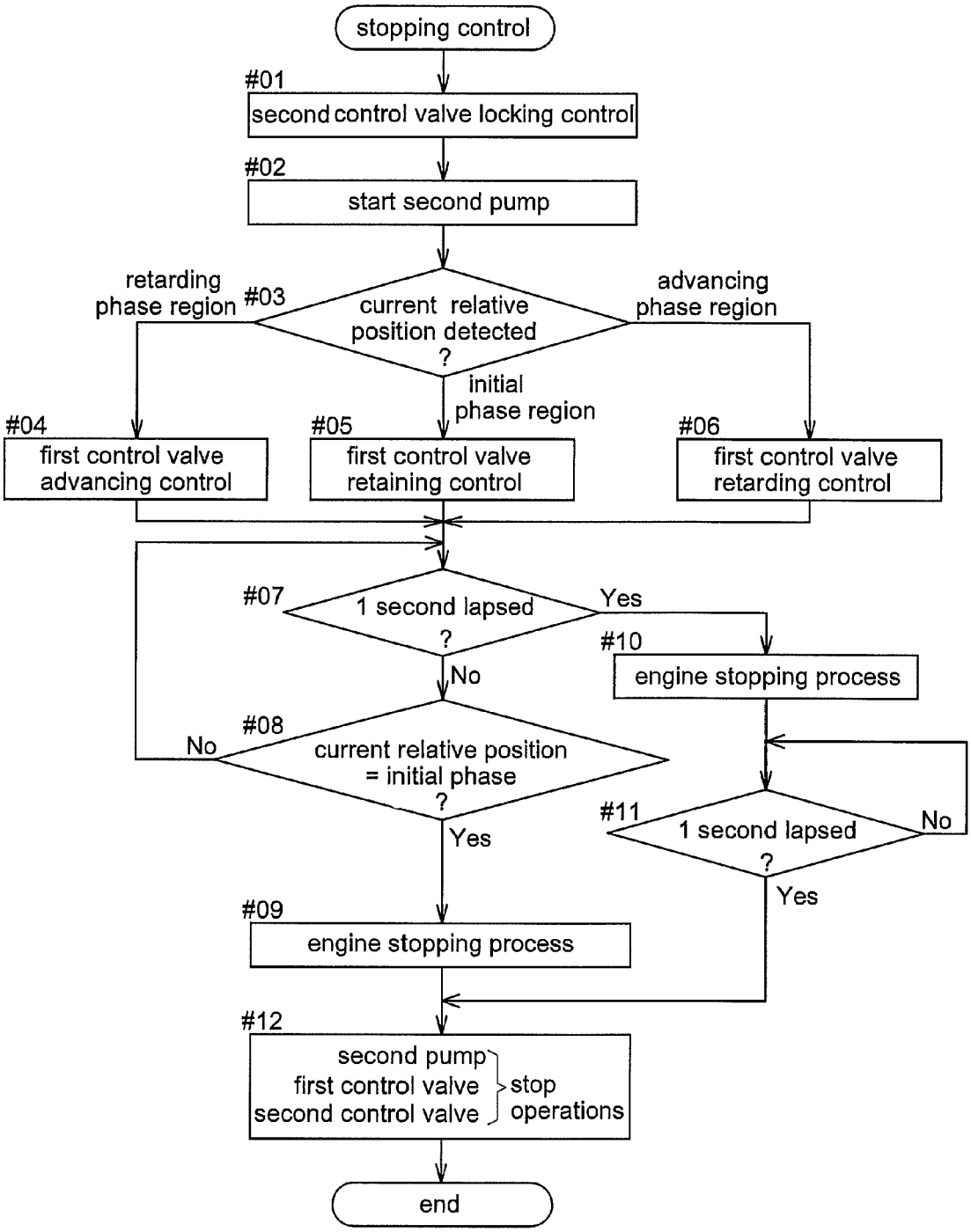
FIG. 5 is a flowchart of a stopping control.

An example of the controlling operation executed by the valve opening/closing timing control apparatus at the time of stopping the engine will be explained with reference to the flowchart in FIG. 5. This stopping control process is initiated upon issuance of request for engine stopping by an OFF operation of the ignition key. At the time of OFF operation of the ignition key, in general, the engine is under its idling rotation. So, with the OFF operation of the ignition key, its rotational speed begins to decrease toward the stop state.

First, upon initiation of the stopping control, the control unit 8 activates the second control valve 75 for discharging the work oil from the locking mechanism 6 and lets the movements of the locking pieces 60A and 60B of the locking mechanism 6 subjected to the force of the spring 61 in this projecting direction (#01). In order to compensate for subsequent reduction in the oil pressure due to the stop of the first pump 71 associated with the engine stop, the second pump 72 is started (#02). Then, based on signals from the sensor for detecting the crank angle and the sensor for detecting an angular phase of the cam shaft, the control unit 8 obtains a current relative phase ("current relative phase") and executes a control operation corresponding to a difference between this current relative phase and the initial phase (#03).

If the current relative phase is located in the retarding range, the process executes the advancing control for operating the first control valve 74 to feed the work oil to the advancing chamber 2B and to discharge the work oil from the retarding chamber 2A (#04). Incidentally, as this operation is executed generally while the engine is under the idling condition as described above, there is high possibility that the relative phase is located in the proximity of the most retarding phase. In this advancing control, the force tending to displace the phase toward the initial phase as the locking position comprises the spring force of the torsion spring 3 and the hydraulic force of the second pump 72 and the force resistant to this comprises the cam reaction force and viscosity reactive force in case the oil has high viscous load. So, there is a very strong force tending to displace the phase toward the initial phase, so that the phase will be returned to the initial phase speedily. At the initial stage of the advancing control, the advancing locking piece 60A which was engaged in advance into the retaining recess 62A will come into contact with the retarding side end of the retaining recess 62M when the advancing locking piece 60B is returned to the initial phase. Similarly, at the initial stage, the retarding locking piece 60A which was pressed against the surface of the driven-side rotational member 11 will pass the bottom face of the restriction assisting retaining recess 62*a* and engage into the retaining recess 62M upon returning to the initial phase and come into contact with the advancing side end of the retaining recess 62M.

In case the current relative phase is located in the initial phase region, the retaining control will be executed. In this retaining control, the first control valve 74 may be set to the neutral position and the second pump too can be stopped at this stage (#05). If the current relative phase is located in the initial phase region, this is a situation where either the retarding locking piece 60A presses the bottom face of the first assisting retaining recess 62*a* or the advancing locking piece 60B presses the bottom face of the first assisting retaining recess 62*b*, or where both the retarding locking piece 60A and the advancing locking piece 60B are engaged in the retaining recess 62M. In the case of the latter situation where both the retarding locking piece 60A and the advancing locking piece 60B are engaged in the retaining recess 62M, the locking state is completed already. Whereas, in the case of the former situation where either one of the retarding locking piece 60A and the advancing locking piece 60B is engaged in the first assisting retaining recess 62*a* or the second assisting retaining recess 62*b*, the displacement width of the relative displacement is only the length of the retaining recess. Therefore, even if the first control valve 74 and the second control valve 75 are set to the neutral position, the relative phase will be returned to the initial phase by the spring force of the torsion spring 3 and/or the cam reaction force, so that both the retarding locking piece 60A and the advancing locking piece 60B will be engaged into the retaining recess 62M.

If the current relative phase is located in the advancing region, then, the process executes a retarding control in which the first control valve 74 is operated to feed work oil to the retarding chamber 2A and to discharge work oil from the advancing chamber 2B (#06). This situation is apt to occur in such case when an OFF operation of the ignition key is effected while the engine is not under the idling state. In this retarding control, the force for displacement toward the initial phase comprises not only the hydraulic force provided by the second pump 72, but also the cam reaction force or the viscosity reaction force in the case of high oil viscous load, while the spring force of the torsion spring 3 is not involved. Therefore, the relative phase will be returned to the initial phase speedily.

After execution of one of the controls of the advancing control (#04), the retaining control (#05) and the retarding control (#06) based upon the detection result of the current relative phase, the process first checks whether a period of 1 (one) second has lapsed or not (#07). If the one-second period has not lapsed ("NO" branching at #07), the process further checks whether the current relative phase has returned to the initial phase or not (#08). If it is found that the current relative phase has returned to the initial phase and the phase is locked thereto ("YES" branching at #08), then, an engine stopping process is executed (#09). Then, the process goes on to execute completing processes such as stopping of the second pump 72, the first control valve 74, the second control valve 74 (#12). At step #07, if the one-second period has lapsed before the current relative phase returns to the initial phase ("YES" branching at #07), the process effects an engine stopping operation (#10) and then effects checking of the one-second period lapse (#11). That is, after giving the allowable extension period of one-second ("YES" branching at #11), the process jumps to step #12 to effect the completing process.

With the above-described stopping control, the phase will normally be locked to the initial phase at the time of stopping the engine. So, at the time of restart, there is no need to execute the relative phase displacement control for displacement to the initial phase. However, even in case the relative phase could not return to the initial phase due to some irregular engine stop, such as an engine stall, with the above-described advancing control or retarding control, even when no sufficient oil pressure is obtained with the first pump, the phase can be locked to the initial phase in a reliable manner and then the engine can be started.

Other Embodiments

<1> In the case of the embodiment shown in FIG. 2, the bottom face of each one of the first assisting retaining recess

62*a* and the second assisting retaining recess 62*b* against which the tip ends of the locking pieces 60A, 60B of the locking mechanism 6 are pressed, extends substantially parallel with the outermost peripheral face 2A of the inner rotor 2. Instead, this can be formed as a flat inclined face having a progressively increasing depth toward the retaining recess 62M adjacent thereto. With this inclination, the locking pieces 60A, 60B once engaged into the first assisting retaining recess 62*a* and the second assisting retaining recess 62*b* can easily move in the direction of the retaining recess 62M.

<2> In the embodiment shown in FIG. 2, there is provided the retaining recess 62M common to the locking pieces 60A, 60B. Instead, separate retaining recesses 62M may be provided respectively therefor.

<3> In the embodiment shown in FIG. 2, the locking mechanism 6 includes two locking pieces 60A, 60B. Instead, it is possible to provide one locking piece and to set the length of the retaining recess 62M substantially equal to the width of the locking piece and to provide one or more relatively long assisting retaining recesses with a step difference therebetween on the opposed sides of this retaining recess, thereby to restrict the displacement range of the relative phase in a stepwise fashion.

INDUSTRIAL APPLICABILITY

The present invention, as embodied as a valve opening/closing timing control apparatus capable of completing locking to the initial phase at the time of stopping the engine and allowing the control operation in the retarding direction to proceed smoothly even at the minimal oil pressure, in spite of using an urging mechanism having a strong urging force, is applicable as a peripheral device for various types of engine.

The invention claimed is:

1. A valve opening/closing timing control apparatus comprising:

a phase displacing mechanism for displacing relative phase between a drive-side rotational member rotatable in synchronism with a crank shaft of an internal combustion engine and a driven-side rotational member arranged coaxially relative to the drive-side rotational member and rotatable in unison with a cam shaft for opening/closing at least one of an intake valve and an exhaust valve of the internal combustion engine, by feeding/discharging a work fluid to/from each one of two kinds of pressure chambers whose capacities are variable in complementing manner with each other by means of a movable partition;

a first pump driven by said internal combustion engine for feeding work fluid to said phase displacing mechanism;

a second pump driven by a drive source different from said internal combustion engine for feeding work fluid to said phase displacing mechanism;

a locking mechanism capable of locking said relative phase to an initial phase suitable for starting the internal combustion engine and releasing this lock by a work fluid when needed, said locking mechanism creating a condition for restricting displacement range of said relative phase in a stepwise fashion; and an urging mechanism configured to provide an urging function for urging said phase displacing mechanism toward an advancing side in a restricted range between from a most retarding phase to said initial phase, a minimal urging force of said urging mechanism within said restricted urging force effective range, being set so as to override the displacing force toward the retarding phase side provided by said phase displacing mechanism fed with the work fluid at a minimal pressure from said first pump; and wherein said locking mechanism includes:

a first locking piece and a second locking piece that are provided on one of said drive-side rotational member and said driven-side rotational member;

a retaining recess provided in the other rotational member for allowing insertion therein of said first locking piece and said second locking piece; and wherein said retaining recess includes a first assisting retaining recess allowing relative displacement of said first locking piece over a predetermined region from said initial phase in the advancing direction and a second assisting retaining recess allowing relative displacement of said second locking piece over a predetermined region from said initial phase in the retarding direction.

2. The valve opening/closing timing control apparatus according to claim 1, wherein a flow passage of the work fluid for the locking mechanism is formed as a flow passage independent of a flow passage of the work fluid for the phase displacing mechanism.

3. The valve opening/closing timing control apparatus according to claim 1, wherein in case said relative phase is off said initial phase region at the time of issuance of request for stopping the internal combustion engine, said second pump is activated during a period from the issuance of the engine stop request to detection of stop of the engine, so as to assist the operation for returning the relative phase to the initial phase.

4. The valve opening/closing timing control apparatus according to claim 1, wherein for the displacement of the relative phase in the retarding direction beyond the initial phase under the condition of the work fluid fed by the first pump having the minimal pressure, said second pump is activated.

* * * * *